US005485187A

United States Patent [19]

Okamura et al.

[11] Patent Number: 5,485,187

[45] Date of Patent: Jan. 16, 1996

[54] INK-JET RECORDING APPARATUS HAVING IMPROVED RECOVERY DEVICE

[75] Inventors: Yoshitaka Okamura, Machida; Hiroshi Sugiyama, Yokohama; Kousuke Yamamoto, Kawasaki, all of Japan

[73] Assignee: Canon Kabushiki Kaisha, Tokyo, Japan

[21] Appl. No.: 953,842

[22] Filed: Sep. 30, 1992

[30] Foreign Application Priority Data

Oct. 2, 1991 [JP] Japan ..... 3-255485
Nov. 22, 1991 [JP] Japan ..... 3-307748

[51] Int. Cl.[6] ..... B41J 2/175
[52] U.S. Cl. ..... 347/85
[58] Field of Search ..... 346/140 R, 75; 347/85, 86, 84

[56] References Cited

U.S. PATENT DOCUMENTS

| | | | |
|---|---|---|---|
| 3,950,761 | 4/1976 | Kashio | 346/140 R |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,494,124 | 1/1985 | Piatt et al. | 346/1.1 |
| 4,511,906 | 4/1985 | Hara | 346/140 R |
| 4,558,333 | 12/1985 | Sugitani et al. | 346/140 R |
| 4,587,535 | 5/1986 | Watanabe | 346/140 R |
| 4,602,662 | 7/1986 | Eremity et al. | 347/85 |
| 4,628,333 | 12/1986 | Terasawa | 346/140 R |
| 4,723,129 | 2/1988 | Endo et al. | 346/1.1 |
| 4,737,801 | 4/1988 | Ichihashi et al. | 346/140 R |
| 4,740,796 | 4/1988 | Endo et al. | 346/1.1 |
| 4,791,438 | 12/1988 | Hanson et al. | 347/85 |
| 4,987,429 | 1/1991 | Finley et al. | 346/1.1 |
| 5,185,614 | 2/1993 | Courian et al. | 346/140 R |

FOREIGN PATENT DOCUMENTS

| | | | |
|---|---|---|---|
| 0071566 | 5/1980 | Japan | 346/140 R |
| 59-123670 | 7/1984 | Japan . | |
| 59-138461 | 8/1984 | Japan . | |
| 0064751 | 3/1988 | Japan | 346/140 R |
| 0009849 | 1/1991 | Japan . | |

*Primary Examiner*—N. Le
*Attorney, Agent, or Firm*—Fitzpatrick, Cella, Harper & Scinto

[57] ABSTRACT

An ink-jet recording apparatus capable of efficiently performing a pressurization recovery operation on a recording head without causing clogging due to dust particles. An ink supply system for supplying ink to the head includes an ink container with an air space defined above the ink surface, and a pump for pressurizing air within the air space, which pump is arranged to connect the air space with either the pressure side of the pump or the atmosphere. In one embodiment, the ink container compriss a main ink tank, and an auxiliary ink tank, having the air space, provided between the head and the main ink tank. The main ink tank is controlled to maintain a predetermined pressure head of ink therein, and the auxiliary ink tank is positioned such that the auxiliary ink tank can have, under atmospheric pressure, substantially the same pressure head as the main ink tank. In another embodiment, a removable ink cartridge, serving as the ink container, is divided into small and large ink chambers. Thus, in either case the pump need only pressurize a small volume of air in the ink container so that, during a recovery operation, the air pressurized by the pump efficiently pressurizes the ink within the auxiliary ink tank or small ink chamber even when the amount of ink has decreased.

14 Claims, 8 Drawing Sheets

INK-JET RECORDING APPARATUS HAVING IMPROVED RECOVERY DEVICE

BACKGROUND OF THE INVENTION

1. Field of the Invention

The present invention relates to an ink-jet recording apparatus. Particularly, the present invention relates to an ink-jet recording apparatus in which an ink supply system, for supplying ink to an ink-jet recording head for ejecting ink for the formation of characters, images, etc., has an improved recovery device for recovering the function of the recording head by applying pressure to ink when clogging has occurred in the recording head due to dried ink, dust particles or the like.

2. Related Background Art

In a conventional ink-jet recording apparatus having an ink supply system for supplying ink to an ink-jet recording head for ejecting ink, satisfactory ejection of ink may become impossible when ink within an ejection nozzle dries due to a long interval between printing operations, or when ink is contaminated with impurities such as dust, or when bubbles have entered the recording head ink chamber. In this case, an operation for causing the recording head to recover its function is performed. A recovery operation utilizes either pressurization recovery, in which a pressurizing force created by a pump is applied to the ink so that ink within the nozzle is forced out, or suction recovery, in which cap is brought into tight contact with the nozzle and a sucking force created by a pump is applied to generate a negative pressure within the cap so that ink within the nozzle is drawn out. A pressurization recovery operation employs a pump such as a plunger (piston) pump, a gear pump or a turbine pump. Such pumps fall into two types: the type in which ink, passed through the interior of the pump itself, is directly pressurized (hereinafter referred to as "the direct pressurization type"); and the type in which the pump pressurizes air and the air pressurizes ink (hereinafter referred to as "the indirect pressurization type"). Hitherto, a pump of the direct pressurization type has often been arranged between the ink container (comprising an ink tank or ink cartridge) and the recording head. A pump of the indirect pressurization type has often been arranged to directly connect with a tightly-sealed ink tank (cartridge) so that the air within the ink tank may be pressurized to force out ink.

An ink-jet recording head may have ink-ejection nozzles arranged at a high density, such as in the case of an ink-jet recording head in a bubble-jet recording system in which heaters, provided inwardly of the nozzles, generate heat to cause a change in the state of ink, and pressure generated thereby is utilized to eject ink. A pressurization recovery operation has the following problems when dealing with the above kind of ink-jet recording head: If a direct pressurization type of pump arranged between the ink tank and the head is employed, after a long period of use, nozzles as well as filters provided between the nozzles and the ink tank tend to be clogged with particles conveyed from sliding portions of the pump. An indirect pressurization type of pump for pressurizing the air within a tightly-sealed ink tank can face problems when the amount of ink contained in the ink tank has decreased and, accordingly, a relatively large amount of air is present inside the tank. In such circumstances, the delivery of a fixed amount of air for pressurizing the ink may fail to cause a predetermined pressure to be applied to the ink within a sufficiently short period of time, or may fail to provide the desired pressure.

SUMMARY OF THE INVENTION

In view of the above-described problems, a primary object of the present invention is to provide an ink-jet recording apparatus capable of efficiently recovering the function of the ink-jet recording head using pressure without causing contamination with dust particles, and the resultant possible clogging of nozzles and filters.

Another object of the present invention is to provide an ink-jet recording apparatus having a recording head and a main ink tank for maintaining ink at a predetermined pressure head for supply to the recording head, wherein the apparatus comprises an auxiliary ink tank for storing ink with an air space above an ink surface in the auxiliary ink tank, wherein ink in the auxiliary ink tank assumes substantially the same pressure head as the ink in the main ink tank when the air space is at atmospheric pressure, a first ink supply section including a one-way valve for permitting ink flow from the main ink tank to the auxiliary ink tank and preventing ink flow from the auxiliary ink tank to the main ink tank, a second ink supply section for supplying ink from the auxiliary ink tank to the recording head, and an air pressurizing pump for delivering a fixed amount of air under pressure to the air space above the ink surface within the auxiliary ink tank during a recording head recovery operation, and thereafter restoring atmospheric pressure within the air space.

Preferably, the air pressurizing pump includes a hollow cylinder having a first end providing a discharge port communicating with the auxiliary ink tank and a second end opening to the atmosphere, a piston for sliding within the cylinder and having a communication opening through which the discharge port can communicate with the second open end, and a rod for moving the piston, the rod having an integral valve for closing the communication opening when the piston advances from the second open end to the first end, and for opening the communication opening when the piston retracts from the first end to the second end. Preferably, the air pressurizing pump performs at least one pressurizing operation per recording head recovery operation, and stops at a position at which the communication opening of the piston is open when a recovery operation has been completed.

Preferably, the volume of the air space in the auxiliary ink tank is smaller than the volume of an air space above an ink surface in the main ink tank. The amount of air delivered by a single operation of the air pressurizing pump is greater than the volume of the air space in the auxiliary ink tank.

When the air-pressurizing pump delivers air under pressure to the air space within the auxiliary ink tank, pressure is applied to the ink within the auxiliary ink tank so that ink is ejected from the recording head through the second ink supply section. At this time, the one-way valve of the first ink supply section prevents flow of ink from the auxiliary ink tank to the main ink tank so that none of the ink in the auxiliary ink tank flows to the main ink tank. Thereafter, when the air pressurizing pump restores atmospheric pressure in the auxiliary ink tank, ink is supplemented from the main ink tank through the first ink supply section, and control is effected to maintain the pressure head also in the main ink tank. Thus, the pressure head in the main ink tank and that in the auxiliary ink tank are made substantially the same, and printing can be effected in this condition.

A further object of the present invention is to provide another ink-jet recording apparatus comprising an ink-jet recording head for ejecting ink, an air pressurizing pump for delivering an amount of pressurized air, and an ink cartridge for supplying ink to the ink-jet recording head, the ink cartridge being removably mountable to the apparatus and including a large ink chamber and a small ink chamber for containing ink, wherein the small ink chamber communicates with the air pressurizing pump and the ink-jet recording head when the cartridge is mounted to the apparatus, communicating means for permitting ink flow from the large ink chamber to the small ink chamber and preventing ink flow from the small ink chamber to the large ink chamber; and an opening for communicating the large ink chamber with the atmosphere.

Since air in an ink chamber of a small volume is pressurized, the ink therein can be efficiently pressurized. Since the present invention uses air under pressure, the ink does not mix with dust, thereby preventing clogging from occurring in the recording head even after a long time. In addition, the use of a removable ink cartridge is advantageous in that an empty cartridge can be replaced easily.

DETAILED DESCRIPTION OF THE PREFERRED EMBODIMENTS

Embodiments of the present invention will now be described with reference to the drawings.

Figure 1:
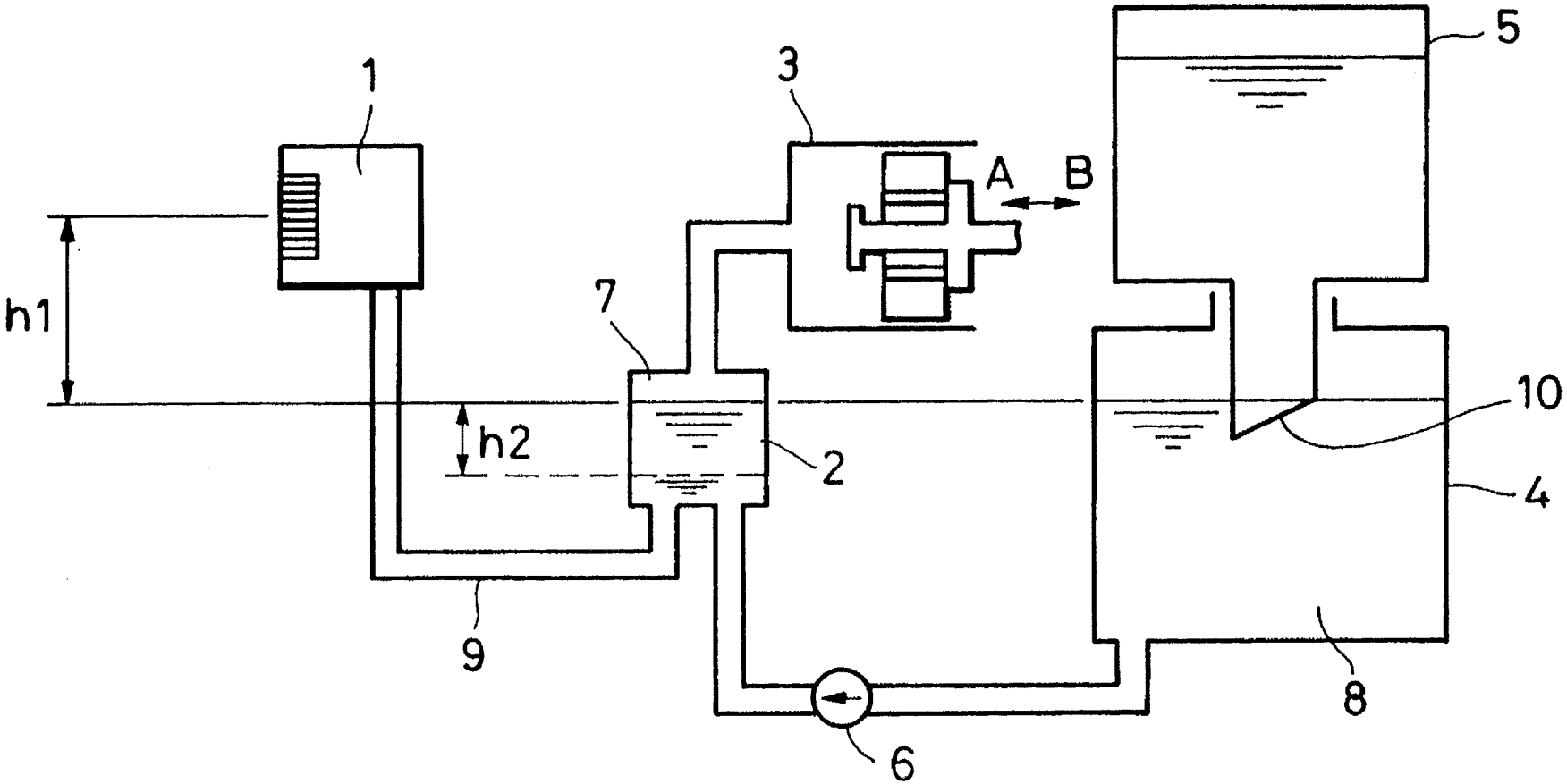
FIG. 1 schematically depicts a first embodiment of an ink supply system of an ink-jet recording apparatus according to the present invention.

Referring to FIG. 1, an ink-jet recording apparatus, such as a printer, according to the present invention includes an ink-jet recording head 1 for ejecting ink in accordance with an electrical signal, and an ink supply system for supplying ink to the recording head 1. The ink supply system includes a main ink tank 4 for storing ink 8, an auxiliary ink tank 2 for containing a fixed amount of ink 8, and an air pressurizing pump 3 for pressurizing air in the air space 7 defined in the auxiliary ink tank 2 above the ink surface therein. A first ink supply section includes a one-way valve mechanism 6 disposed in a tube connecting the main ink tank 4 with the auxiliary ink tank 2. The valve mechanism 6 prevents ink from flowing backward from the auxiliary ink tank 2 to the main ink tank 4 when air within the auxiliary ink tank 2 is pressurized by the air pressurizing pump 3. Another tube 9, through which ink may flow, provides a second ink supply section that connects the auxiliary ink tank 2 with the recording head 1. An ink cartridge 5 is provided, which can be replaced easily when it is empty. An ink outlet 10 is connected with the ink cartridge 5, and arranged such that, when ink contained in the main ink tank 4 has decreased, a part of the ink contained in the cartridge 5 naturally flows downward through the outlet 10.

Figure 2A:
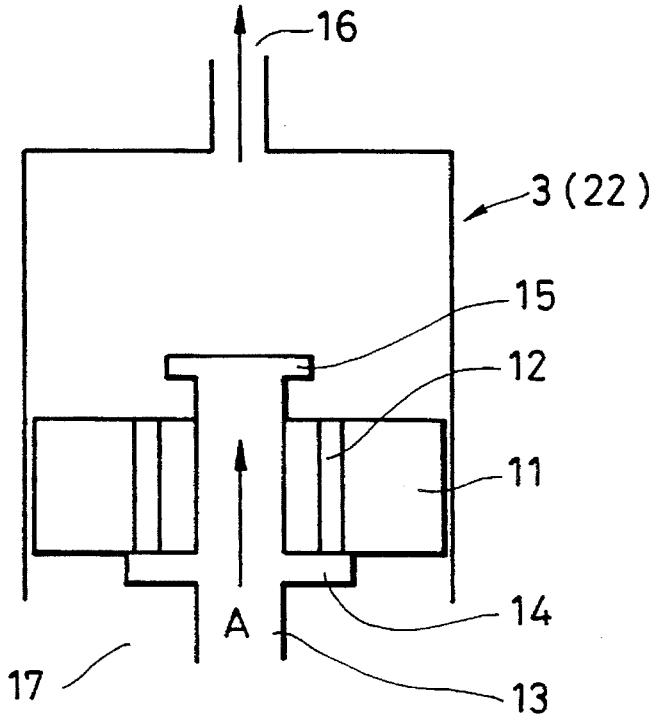
FIGS. 2(*a*) and 2(*b*) are views of an air pressurizing pump of the first embodiment, showing the construction and operation of the pump.
Figure 2B:
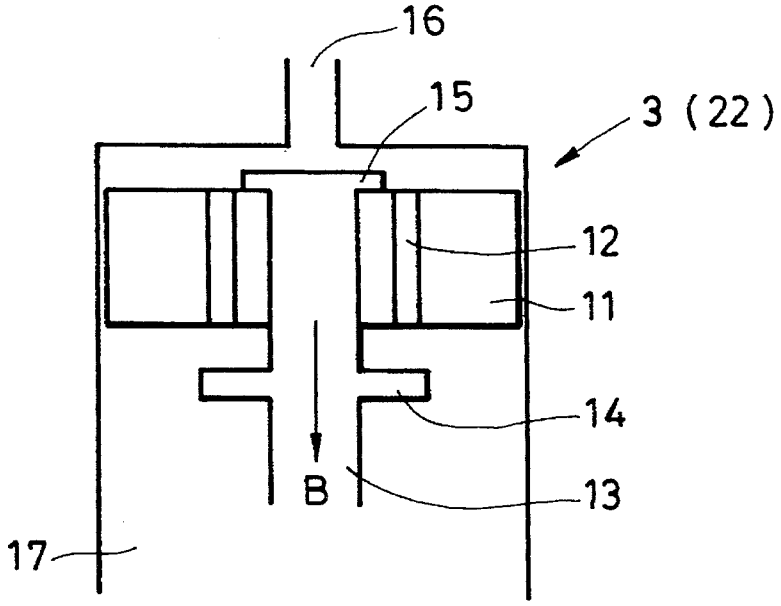

Referring to FIGS. 2(*a*) and 2(*b*), the air pressurizing pump 3 has a piston 11, and a rod 13 for reciprocating the piston 11 within a cylinder. A first end of the cylinder has a discharge port 16, and a second end 17 thereof opens into the atmosphere. A communication opening 12 is formed through the piston 11, and a valve 14 is formed integrally with the rod 13. The valve 14 closes the communication opening 12 only when the piston 11 advances to the discharge port 16 of the cylinder. A washer 15 prevents disengagement of the piston 11 from the rod 13. It is preferable that the volume of air delivered by a single pressurizing operation of the pump 3 be greater than the volume of the air space 7 within the auxiliary ink tank 2. In this way, the delivered air is able to efficiently pressurize the ink within the ink tank 2.

The operation of the first embodiment will be described. When the power supply (not shown) of the recording apparatus is turned on, a recovery operation is performed as a preparation for recording (printing) to secure the ejection of ink from the recording head 1 (the recording head will hereinafter be referred to as "the head" unless otherwise specified).

The rod 13 of the air pressurizing pump 3, which has held the piston 11 at a position close to the second open end 17 of the cylinder, is driven by a motor or the like (not shown), so that the piston 11 advances toward the discharge port 16 in the direction indicated by arrow A in FIGS. 1 and 2(*a*). During this movement, compression takes place while the valve 14 closes the communication opening 12; as a result, the air within the space of the cylinder ahead of the piston 11 is compressed, and is thus pressurized. A fixed amount of pressurized air is thus delivered through the discharge port 16 to the air space 7 within the auxiliary ink tank 2, to thereby pressurize the ink within the ink tank 2. A part of the pressurized ink flows toward the head 1, lowering the ink surface within the auxiliary ink tank 2 by a corresponding amount $h_2$ (see FIG. 1). That part of the ink is prevented from flowing to the main ink tank 4 by the operation of the valve mechanism 6. In the illustrated embodiment, the volume of the air space 7 within the auxiliary ink tank 2 is smaller than the volume of the air space within the main ink tank 4. This is advantageous in that pressurized air delivered to the air space 7 can efficiently pressurize the ink within the auxiliary ink tank 2. After reaching the head 1, part of the ink is ejected, causing dust, dried ink, bubbles, etc. within the head 1 to be forced out. The ejected ink containing the dust, etc. flows into a cap (not shown), and the surface of the head 1, which is contaminated with the ink, dust, etc. is cleaned by a suitable means such as a rubber blade.

Thereafter, the rod 13 is driven to move the piston 11 of the air pressurizing pump 3 toward the second open end 17 in the direction indicated by arrow B in FIGS. 1 and. 2(*b*). At this time, the valve 14 is spaced away from the communication opening 12 so that the interior of the cylinder, that is, the interior of the pump 3, communicates with the atmosphere through the second open end 17 and the opening 12. As a result, atmospheric pressure is restored in the air space 7 within the auxiliary ink tank 2, allowing a certain amount of ink to be supplemented from the main ink tank 4 into the auxiliary ink tank 2, until the ink surface in the auxiliary ink tank 2 returns to the level hi (see FIG. 1), which is substantially the same as the ink level within the main ink tank 4. This causes a drop in the ink level in the main ink tank 4, which is compensated for by an amount of ink flowing down from the ink cartridge 5 until the original ink surface level hi is restored also within the main ink tank 4. That is, the main ink tank 4 maintains the ink at a predetermined pressure head for supply to the recording head 1.

In this way, the volume of the air space 7 within the auxiliary ink tank 2 is maintained. This enables a fixed amount of air to be compressed and delivered by the air pressurizing pump 3 to apply a constant pressure to ink within the auxiliary ink tank 2. Thus, even when the amount of ink in the ink supply system has decreased, the volume of the air space 7 does not change, enabling the efficiency with which ink within the ink tank 2 is pressurized to be maintained at a high level.

When the recovery operation has completed, the rod 13 of the air pressurizing pump 13 stops at a position at which the valve 14 is spaced away from the communication opening 12 so that no positive pressure is applied to the ink within the auxiliary ink tank 2.

During printing, the ink in the ink supply system is not pressurized but is kept under a pressure corresponding to the pressure head indicated by the symbol $h_1$ in FIG. 1. This makes it possible to stabilize the ejection of ink, and hence to stabilize the level of image quality.

Although in the above description a recovery operation is performed when the power supply is turned on, a recovery operation may be performed whenever necessary, for example, when print quality has decreased.

Second and third embodiments of the present invention will be described with reference to FIGS. 3 and 4, respectively.

Figure 3:
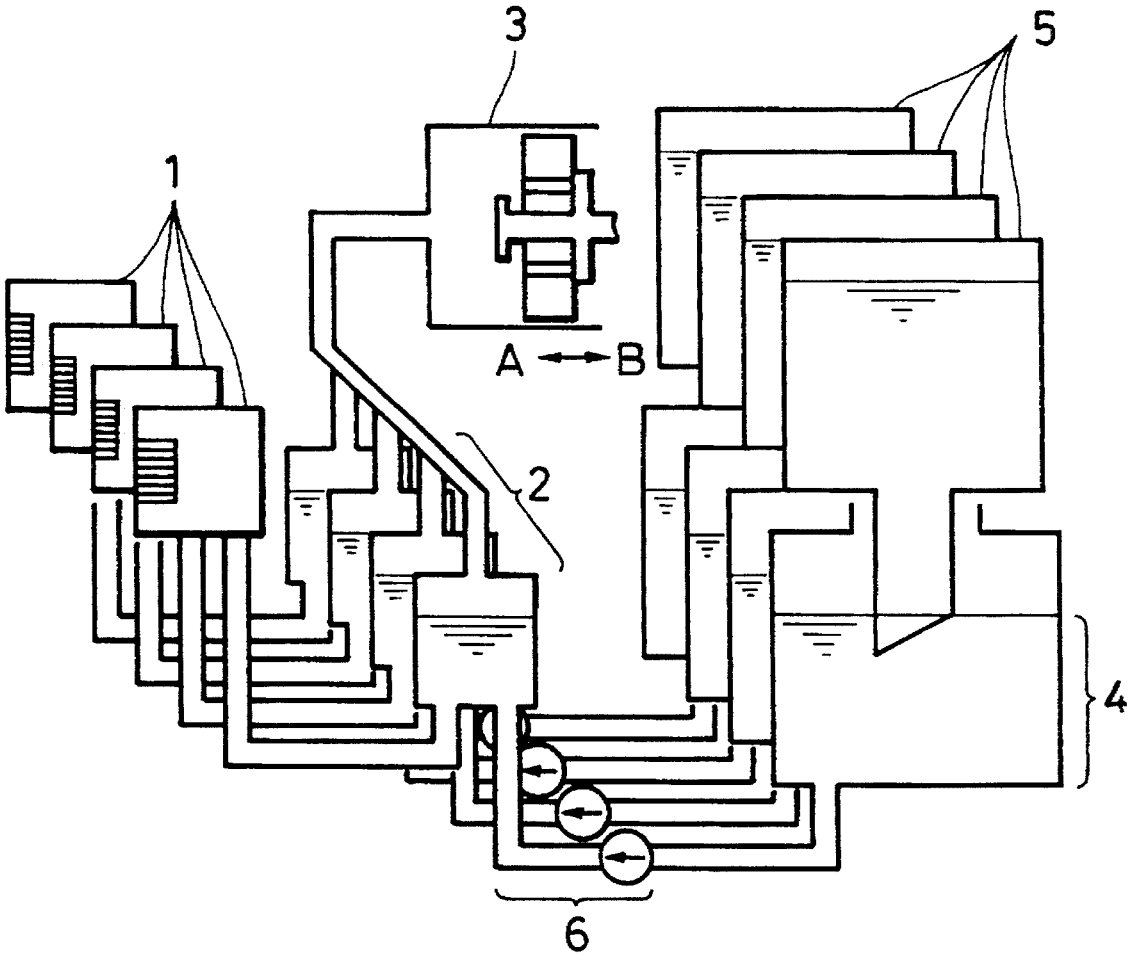
FIG. 3 schematically depicts a second embodiment of the present invention.

Referring to FIG. 3, a second embodiment is distinguished in that it is adapted for color recording by providing a plurality of heads 1 in correspondence with four colors, yellow, magenta, cyan and black, and arranging in parallel a plurality of ink supply systems, each being similar to the system shown in FIG. 1, in correspondence with these colors. The embodiment includes a single air pressurizing pump 3. Since pumps are relatively expensive, the above construction is advantageous in that only one pump is used and, accordingly, only one pump-drive source is necessary, thereby incurring lower production costs than a case where a plurality of pumps and drive sources are provided. Another advantage is that the four heads 1 are recovered at substantially the same time, thereby assuring that the ejecting conditions of the four heads 1 are always substantially the same. This makes it possible to obtain good images produced by variation-free recording. The construction of the remaining features of the second embodiment is the same as that of the first embodiment.

The heads 1 may not necessarily require a recovery operation to the same extent or at the same time. Therefore, it is of course possible to provide a plurality of pumps independently operable for each of the heads 1. The provision of such a plurality of pumps is advantageous in that each head can be subjected to independent recovery operations in a reliable manner.

Figure 4:
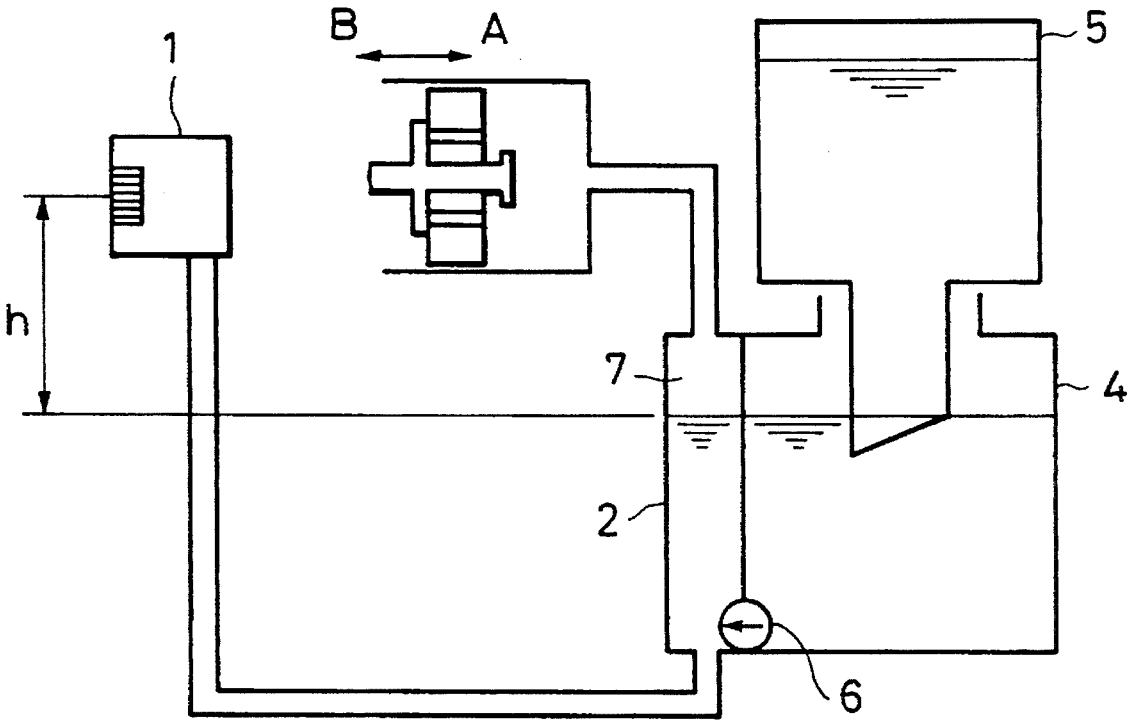
FIG. 4 schematically depicts a third embodiment of the present invention.

Referring to FIG. 4, a third embodiment is distinguished in that it includes an ink supply system in which the auxiliary and main ink tanks 2 and 4 shown in FIG. 1 are integrated to constitute a single ink tank. This construction is advantageous in that no tube is necessary to connect the auxiliary and main ink tanks together, thereby simplifying the construction of the system. The third embodiment may be adapted for color recording by, as in the second embodiment, arranging in parallel four ink supply systems, each being the same as above. The construction of the remaining features of the third embodiment is the same as that of the first embodiment.

Other embodiments will be described, one using a simplified construction of the tank of the third embodiment, which is further developed by omitting the replenishing ink cartridge 5, and using a tank itself as a replaceable cartridge that is removable from the apparatus, the tank comprising an auxiliary tank portion and a main tank portion.

Figure 5:
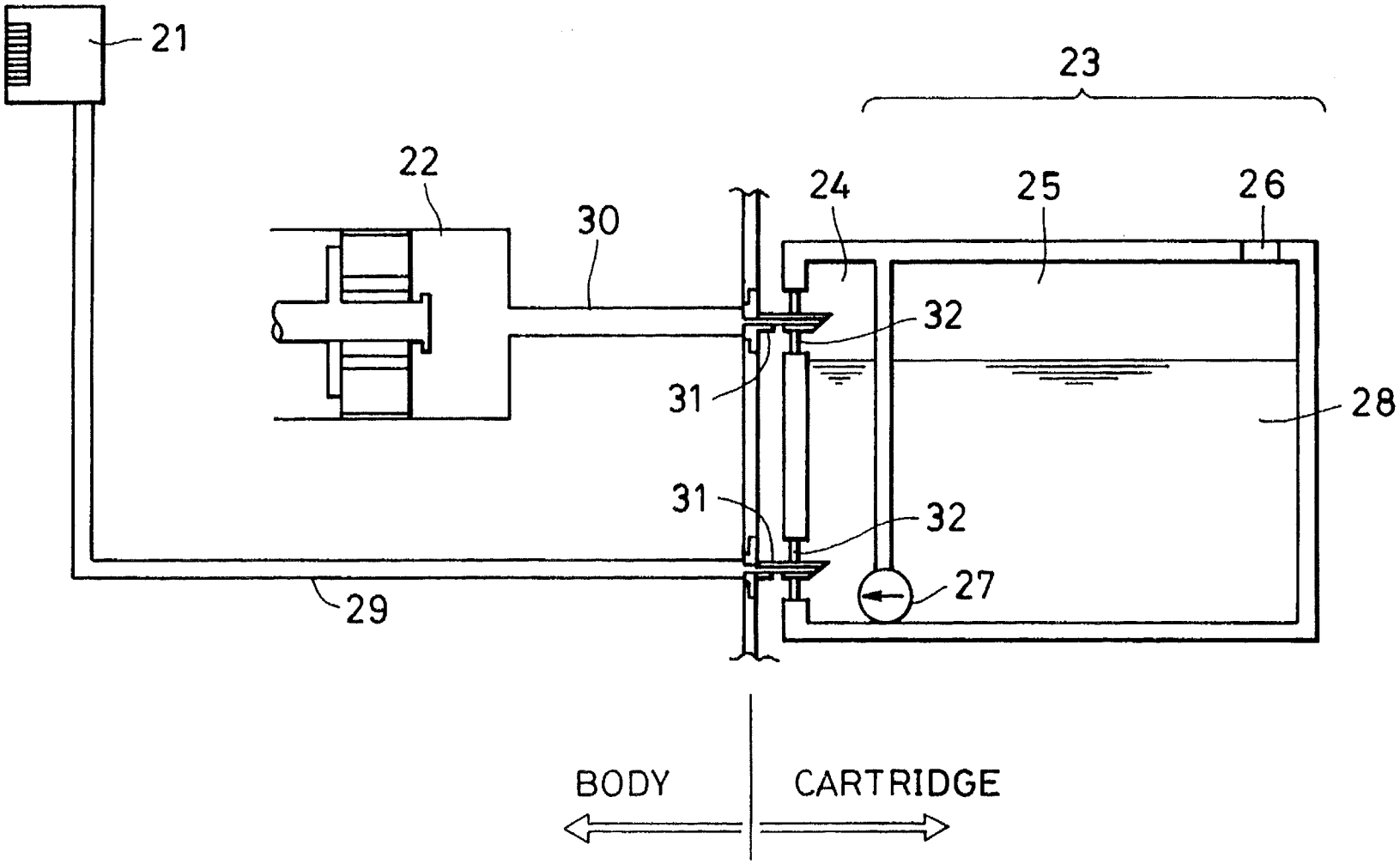
FIG. 5 schematically depicts a fourth embodiment of the present invention.

Referring to FIG. 5, an ink-jet recording apparatus according to a fourth embodiment of the present invention includes a recording head 21 for ejecting ink in accordance with an electrical signal, and an ink supply system including an air pressurizing pump 22 and an ink cartridge 23 for containing ink 28. The ink cartridge 23 is partitioned into a small ink chamber 24 and a large ink chamber 25. The large ink chamber 25 has an air opening 26 at an upper position thereof. A valve mechanism 27 comprises a communicating device provided in a hole formed through the partition between the small ink chamber 24 and the large ink chamber 25. The valve mechanism 27 is capable of permitting the small ink chamber 24 to communicate with the large ink chamber 25, and preventing ink from flowing backward from the small ink chamber 24 to the large ink chamber 25. A tube 29, through which ink may flow, connects the ink cartridge 23 with the recording head 21. Another tube 30, through which air may flow, connects the air pressurizing pump 22 with the ink cartridge 23. The respective ends of the tubes 29 and 30 are provided with first and second hollow needles 31 which penetrate rubber seals 32 when the cartridge 23 is mounted to the apparatus body. The first needle 31 attached to the tube 29 projects into the ink within the small ink chamber 24, while the second needle 31 attached to the tube 30 projects into the air space of the ink chamber 24. The rubber seals 32, made of a material such as chlorinated butyl rubber, can provide air-tightness even when the needles are removed. The air pressurizing pump 22 used in this embodiment may have a construction similar to that shown in FIGS. 2(*a*) and 2(*b*) .

The operation of the fourth embodiment will now be described. When the power supply (not shown) of the recording apparatus is turned on, a recovery operation is performed as a preparation for recording (printing) to secure the ejection of ink from the head 21.

The rod 13 of the air pressurizing pump 22, which has held the piston 11 at a position close to the second open end 17 of the cylinder, is driven by a motor or the like (not shown), so that the piston 11 advances toward the discharge port 16 in the direction indicated by arrow A in FIG. 2(*a*). During this movement, compression takes place while the valve 14 closes the communication opening 12; as a result, the air within the space of the cylinder ahead of the piston 11 is compressed, and is thus pressurized. The pressurized air is delivered through the tube 30 into the air space above the ink surface within the small ink chamber 24, to thereby pressurize ink within the ink chamber 24. When pressurization is thus performed within the small ink chamber 24, the valve mechanism 27 closes the associated hole. Accordingly, a part of the pressurized ink flows to the head 21, in which part of the ink causes dried ink, dust, etc. remaining in the nozzle to be forced out. The volume of the air space within the small ink chamber 24 is smaller than the volume of the air space within the large ink chamber 25. This is advantageous in that the air pressure within the small ink chamber 24 can be increased to a sufficient level even with a pump whose displacement is not very great, thus making it possible to effect efficient ink pressurization.

Thereafter, the rod 13 is driven to move the piston 11 of the air pressurizing pump 22 toward the second open end 17 in the direction indicated by arrow B in FIG. 2(*b*). At this time, the valve 14 is spaced from the communication opening 12 so that the interior of the cylinder, that is, the interior of the pump 22, communicates with the atmosphere through the second open end 17 and the opening 12, whereby the air space within the small ink chamber 24 communicates with the atmosphere. Since the large ink chamber 25 communicates with the atmosphere through the air opening 26, both the small ink chamber 24 and the large ink chamber 25 now communicate with the atmosphere. As a result, a certain amount of ink is supplemented from the large ink chamber 25 into the small ink chamber 24 through the valve mechanism 27, which is now open, until the ink surface in the small ink chamber 24 reaches the same level as the ink surface within the large ink chamber 25.

As such supplementation is repeated, it causes gradual increases in the amount of air within the ink cartridge 23. However, according to this embodiment, these increases do not cause any substantial reduction in pressurization efficiency because the air in the small-volume chamber 24 can still be effectively pressurized. With this construction, even when the amount of ink in the cartridge 23 has decreased, the amount of air within the small chamber is still small enough to enable sufficiently efficient pressurization.

The above-described recovery operation may be performed not only when the power supply is turned on but also whenever it is necessary, for example, when the print quality has lowered.

The air opening 26 of the large ink chamber 25 may have an arrangement in which the opening 26 is closed when the ink cartridge 23 is not mounted on the body of the apparatus, and opened by a cam or the like (not shown) when the cartridge 23 is mounted.

A recording-head recovery device capable of the above-described operation may be incorporated in an ink-jet recording apparatus of the type having an ink-jet recording head cartridge.

Figure 8:
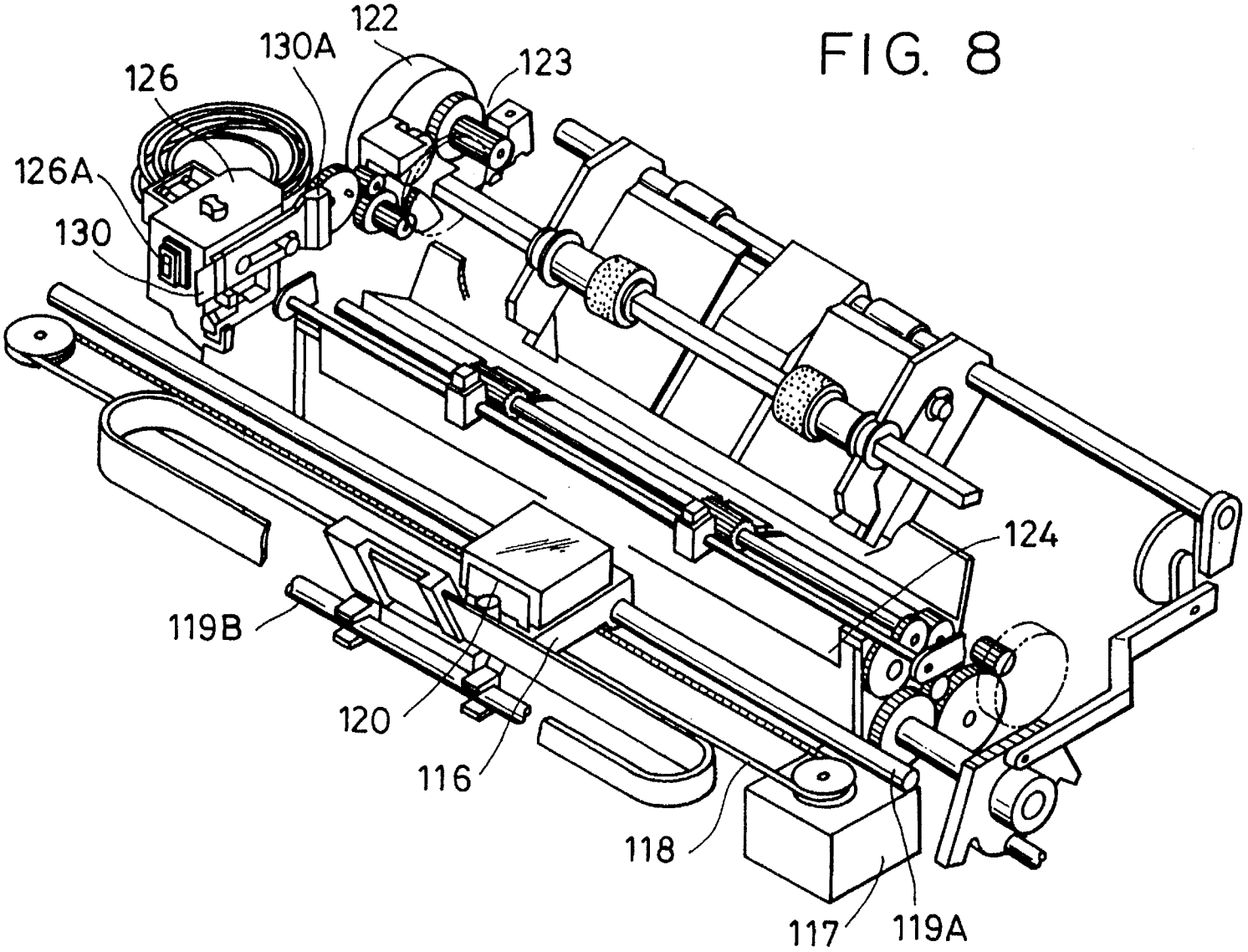
FIG. 8 is a perspective view of the relevant parts of an ink-jet recording apparatus incorporating an ink supply system according to the present invention.

FIG. 8 shows, in a perspective view, an example of such an apparatus. An ink.-jet recording apparatus includes an ink-jet recording head cartridge (hereinafter abbreviated to "IJC") 120 having a plurality of nozzles for ejecting ink onto a recording surface of recording paper fed onto a platen 124. The IJC 120 is held by a carriage 116 which is in turn connected to a part of a drive belt 118 for transmitting driving force of a drive motor 117, and is slidable on a pair of guide shafts 119A and 119B disposed parallel to each other, whereby the IJC 120 is rendered capable of reciprocating along a path covering the full width of the recording paper.

The apparatus also includes a head recovery unit 126 disposed at a position facing one of the ends of the path of the reciprocation of the IJC 120, for example, the home position of the IJC 120. The head recovery unit 126 has a cap portion 126A. In a recovery operation employing the head recovery unit 126, when the driving force of a motor 122 is transmitted through a transmission mechanism 123, the head recovery unit 126 is operated to effect capping of the IJC 120 with the cap portion 126A. In relation with this capping by the unit 126, a suction means provided in the head recovery unit 126 or a pressurization means provided in the ink supply passage leading to the IJC 120 is operated to effect suction or pressure-delivery of ink, so that viscous ink, etc. within the nozzle, is forced out or drawn out, and is thus removed to allow recovery of the recording head. Capping is also effected after recording in order to protect the IJC 120.

A blade 130, formed of a silicone rubber, is cantilevered by a blade holder 130A on a side surface of the head recovery unit 126, the blade serving as a wiping member. When the blade 130 is operated by the motor 122 and through the transmission mechanism 123, the blade 130 contacts the ejection surface of the IJC 120. The blade 130 is projected into the path of reciprocation of the IJC 120 at an appropriate time during a recording action of the IJC 120, or after the completion of a recovery operation employing the head recovery unit 126, so that, while the IJC 120 moves, dew, moisture, dust, etc. are wiped off the ejection surface of the IJC 120.

Fifth and sixth embodiments of the present invention will be described with reference to FIGS. 6 and 7, respectively.

Figure 6:
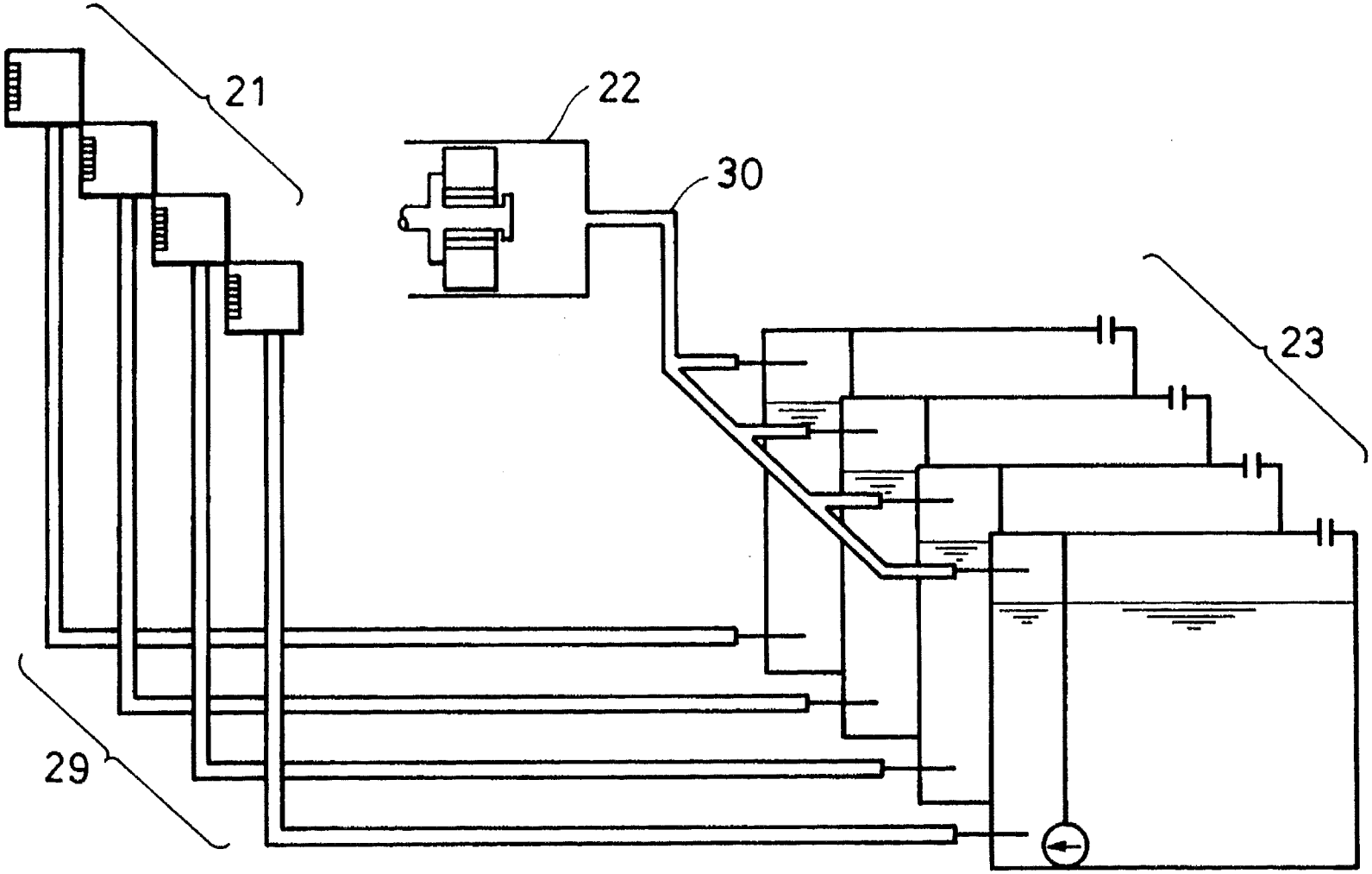
FIG. 6 schematically depicts a fifth embodiment of the present invention.

Referring to FIG. 6, a fifth embodiment is distinguished in that it is adapted for color recording by providing a plurality of heads 21 in correspondence with four colors, yellow, magenta, cyan and black, and arranging in parallel a plurality of ink supply systems, each being similar to the system shown in FIG. 5, in correspondence with these colors. The embodiment includes a single air pressurizing pump 22. Since pumps are relatively expensive, the above construction is advantageous in that only one pump is used and, accordingly, only one pump-drive source is necessary, thereby incurring lower production costs than a case where a plurality of pumps and drive sources are used. Another advantage is that the four heads 21 are recovered at substantially the same time, thereby assuring that the heads 21 are under substantially the same conditions. This means that all four heads 21 have substantially the same ink ejecting conditions, thereby enabling good images to be produced by variation-free recording. The construction of the remaining features of the fifth embodiment is the same as that of the fourth embodiment shown in FIG. 5.

For the same reason described above, it is of course possible to provide a plurality of pumps 22 which are operable independently for each of the heads 21. The provision of these pumps enable reliable recording head recovery.

Figure 7:
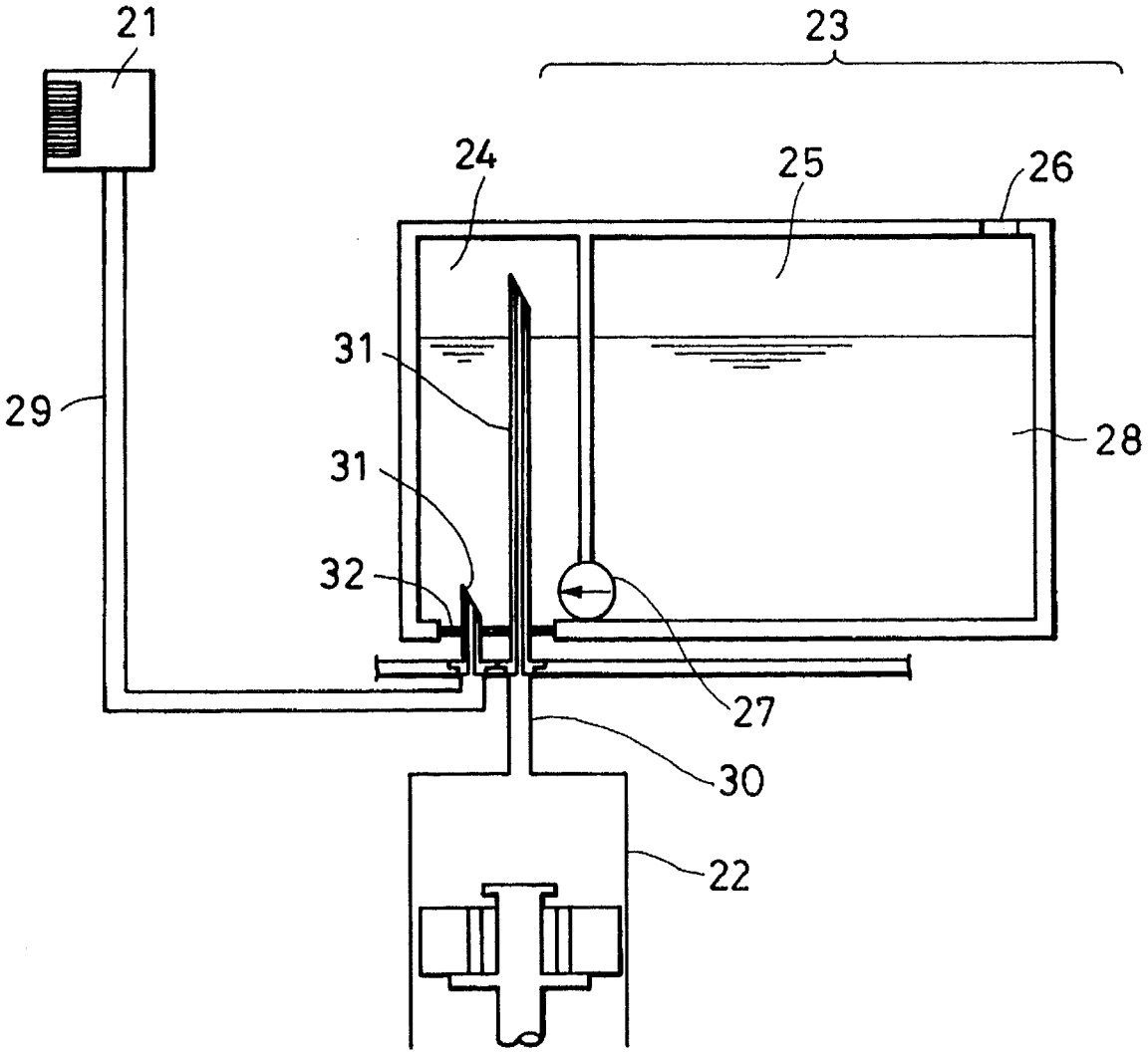
FIG. 7 schematically depicts a sixth embodiment of the present invention.

Referring to FIG. 7, a sixth embodiment is distinguished in that tubes 29 and 30 connecting the ink cartridge 23 with the recording head 21 and the pump 22, respectively, have first and second needles 31 projecting vertically instead of horizontally, as in the fourth embodiment. The second needle 31 projecting into the air space is longer than the first needle 31 projecting into the ink, and the second needle 31 extends to a position above the ink surface. The sixth embodiment may be adapted for. color recording by, as in the fifth embodiment, arranging in parallel four ink supply systems, each being the same as above. The construction of the other features of the sixth embodiment is the same as that of the fourth embodiment.

The present invention provides excellent effects particularly when applied to ink-jet recording heads and apparatuses employing, among various types of ink-jet recording systems, the type utilizing heat energy to form recording liquid droplets which are ejected to effect recording.

The principles and typical constructions of this type of ink-jet recording system are disclosed, for example, in U.S. Pat. Nos. 4,723,129 and 4,740,796. The present invention is preferably carried out by employing such basic principles. In this type of ink-jet recording system, either of the so-called on-demand-type control and continuous-type control may be effected.

That particular type of ink-jet recording system will be briefly described. In accordance with recording information, at least one driving signal is applied to electrothermal energy conversion elements arranged in correspondence with suitable sheets and liquid passages where a recording liquid (ink) is retained. The signal is applied in such a manner as to cause a rapid increase in temperature, which can cause film boiling rather than nucleate boiling in the liquid. Thus, heat energy is generated, causing film boiling on the heat application surface of the recording head. In this way, bubbles can be formed in the liquid in such a manner that each bubble corresponds to one driving signal applied to the electrothermal energy conversion elements. This feature is particularly advantageous to on-demand-control type recording system. The growth and contraction of bubbles is utilized to eject liquid through ejection hole(s), thereby forming at least one liquid droplet. If the driving signal is pulse-shaped, this is preferable because the growth and contraction of bubbles occurs promptly and appropriately, making it possible to perform liquid ejection having particularly good response characteristics. A suitable pulse-shape of the driving signal is that disclosed, for example, in U.S. Pat. No. 4,463,359 or No. 4,345,262. If the temperature raising ratio on the heat application surface is conditioned as disclosed in U.S. Pat. No. 4,313,124, it is possible to perform more excellent recording.

A recording head to which the present invention is applicable may have a construction in which, as disclosed in the above-identified documents, ejection holes, liquid passages, and electrothermal energy conversion elements are combined together (the liquid passages being either linear or right-angled). The recording head may alternatively have a construction in which heat application portions are arranged in a bent region, as disclosed in U.S. Pat. Nos. 4,558,333 and No. 4,459,600.

The present invention is also applicable to a construction where, as disclosed in Japanese Patent Laid-Open No. 59-123670, a plurality of electrothermal energy conversion elements are arranged for ejection through a common slit constituting an ejection hole, or a construction where, as disclosed in Japanese Patent Laid-Open No. 59-138461, an opening for absorbing a pressure wave of heat energy corresponds to an ejection portion.

A type of recording head to which the present invention may be effectively applied is a full-line type of recording head in which the recording device has a length corresponding to the maximum possible width recording medium. Such a full-line recording head may be obtained by constructing one or more recording heads, such as those disclosed in the above-identified documents, into an integral structure consisting of a single recording head or a structure consisting of a combination of a plurality of recording heads.

The present invention is also effectively applicable to a chip-type recording head which is replaceable and can be electrically connected and supplied with ink when mounted on the body of the apparatus, or a cartridge-type recording head integral with the recording-head body.

It is preferable that a recording apparatus according to the present invention is provided with additional recording-head recovery means and other suitable auxiliary means because such additional means can further stabilize the operation of the apparatus. Specific examples of such means include: a capping means, a cleaning means, and a suction means (all for the recording head); and a preheating means including an electrothermal energy conversion element, or another type of heating element, or a combination of these. The addition of means for effecting a pre-ejection mode in which ejection takes place separately from ejection for recording, is also effective in order to stabilize recording.

A recording apparatus according to the present invention may effect recording in various modes besides the mode for recording with a single common color, such as black. That is, the present invention also provides excellent advantages when it is applied to an apparatus constructed for recording with a plurality of different colors, full-color recording by mixing colors, or both. The recording head of such an apparatus may comprise either a single recording head forming an integral structure or a plurality of recording heads combined together.

As has been described above, according to one form of the present invention, an auxiliary ink tank is provided between the ink-jet recording head and a main ink tank, the auxiliary ink tank containing ink and defining above the ink surface an air space. Air within the air space is pressurized by an air pressurizing pump during a recovery operation. With this construction, ink is pressurized by air under pressure, that is, indirectly, thereby enabling a recovery operation that avoids contamination of the ink with dust particles. Thereafter, the air pressurizing pump restores atmospheric pressure, thus removing the pressure applied to the ink. At this time, the ink surface within the auxiliary ink tank is able to naturally stabilize at the same level as the ink surface within the main ink tank. Thus, a constant pressure head of ink is applied to the recording head, thereby making it possible to effect stable ejection of ink, and hence, to assure good print quality for a long time. If the apparatus is adapted for color recording by arranging a plurality of recording heads, only one air pressurizing pump is necessary, thereby simplifying the entire construction.

According to another form of the present invention, an ink cartridge is divided into small and large chambers. Air within the air space of the small chamber is pressurized by an air pressurizing pump. Accordingly, even when the amount of ink within the ink cartridge has decreased and the volume of air therein has increased relatively, it is possible to efficiently pressurize ink. The pressurizing with air does not involve the risk of contamination with dust.

What is claimed is:

1. An ink-jet recording apparatus having a recording head and a main ink tank for maintaining ink at a predetermined pressure for supply to said recording head, said apparatus comprising:

an auxiliary ink tank for storing ink with an air space above an ink surface in said auxiliary ink tank, wherein said auxiliary ink tank is disposed relative to said main ink tank so that the ink in said auxiliary ink tank assumes substantially the same level as the ink in said main ink tank when the air space is at atmospheric pressure;

a first ink supply section including a one-way valve for permitting ink flow from said main ink tank to said auxiliary ink tank and preventing ink flow from said auxiliary ink tank to said main ink tank;

a second ink supply section for supplying ink from said auxiliary ink tank to said recording head; and an air pressurizing pump for delivering a fixed amount of air under pressure to the air space above the ink surface within said auxiliary ink tank during a recording head recovery operation, and thereafter restoring atmospheric pressure within the air space.

2. An ink-jet recording apparatus according to claim 1, wherein said air pressurizing pump includes a hollow cylinder having a first end providing a discharge port communicating with said auxiliary ink tank and a second end opening to the atmosphere, a piston for sliding within said cylinder and having a communication opening through which said discharge port can communicate with said second end, and a rod for moving said piston, said rod having an integral valve for closing said communication opening when said piston advances from said second end to said first end, and for opening said communication opening when said piston retracts from said first end to said second end.

3. An ink-jet recording apparatus according to claim 2, wherein said air pressurizing pump performs at least one pressurizing operation per said recording head recovery operation, and stops at a position at which said communication opening of said piston is open when a recovery operation has been completed.

4. An ink jet recording apparatus according to claim 1, wherein said main tank stores ink therein with an air space above an ink surface in said main ink tank and a volume of the air space in said auxiliary ink tank is smaller than a volume of the air space in said main ink tank.

5. An ink-jet recording apparatus according to claim 1, wherein an amount of air delivered by a single operation of said air pressurizing pump is greater in volume than the air space above the ink surface in said auxiliary ink tank.

6. An ink-jet recording apparatus according to claim 1, wherein said recording head is a full-line type ink-jet recording head having a plurality of ejection holes arranged over a full width of a recording region of a recording medium.

7. An ink-jet recording apparatus according to claim 1, wherein said recording head ejects ink from ejection holes by utilizing heat energy, and includes means for generating heat energy comprising an electrothermal energy conversion element.

8. An ink-jet recording apparatus according to claim 1, having a plurality of recording heads for recording with different color inks and a corresponding plurality of main ink tanks for storing the different color inks, wherein said apparatus further comprises a corresponding plurality of auxiliary ink tanks and first and second ink supply sections communicating with respective said recording heads and main ink tanks and wherein said air pressurizing pump communicates with all of said plurality of auxiliary ink tanks.

9. An ink-jet recording apparatus according to claim 1, wherein said main ink tank and said auxiliary ink tank are integrated.

10. An ink-jet recording apparatus comprising:

an ink-jet recording head for ejecting ink;

an ink cartridge for supplying the ink to said ink-jet recording head, said ink cartridge being removably mountable to said apparatus and including:

a large ink chamber and a small ink chamber for containing the ink, wherein said small in chamber communicates with said ink-jet recording head when said cartridge is mounted to said apparatus, communicating means for permitting ink flow from said large ink chamber to said small ink chamber and preventing ink flow from said small ink chamber to said large ink chamber, wherein the ink in said small ink chamber assumes substantially the same level as the ink in said ink chamber when said small ink chamber is at atmospheric pressure, and an opening for communicating said large ink chamber with the atmosphere; and an air pressurizing pump communicating with said small ink chamber when said cartridge is mounted to said apparatus for delivering an amount of pressurized air to said small ink chamber during a recovery operation, and thereafter restoring said small ink chamber to atmospheric pressure.

11. An ink-jet recording apparatus according to claim 10, wherein said recording head is a full-line type ink-jet recording head having a plurality of ejection holes arranged over a full width of a recording region of a recording medium.

12. An ink-jet recording apparatus according to claim 10, wherein said recording head ejects ink from ejection holes by utilizing heat energy, and includes means for generating heat energy comprising an electrothermal energy conversion element.

13. An ink-jet recording apparatus according to claim 10, having a plurality of said ink-jet recording heads for different color inks and a corresponding plurality of said ink cartridges for storing the different color inks, wherein said air pressurizing pump communicates with said small ink chamber of each of said ink cartridges when said ink cartridge is mounted on said apparatus.

14. An ink cartridge removably mountable to an ink-jet recording apparatus comprising an ink-jet recording head for ejecting ink and an air pressurizing pump for delivering an amount of pressurized air to a connecting member during a recording head recovery operation and thereafter restoring said connecting member to atmospheric pressure, said ink cartridge containing ink to be supplied to said ink-jet recording head, said ink cartridge comprising:

a large ink chamber and a small ink chamber for containing the ink, wherein said small ink chamber communicates with said connecting member and said ink-jet recording head when said cartridge is mounted to said apparatus;

communicating means for permitting ink flow from said large ink chamber to said small ink chamber and preventing ink flow from said small ink chamber to said large ink chamber, wherein the ink in said small ink chamber assumes substantially the same level as the ink in said large ink chamber when said small ink chamber is at atmospheric pressure; and an opening for communicating said large ink chamber with the atmosphere.

* * * * *

UNITED STATES PATENT AND TRADEMARK OFFICE

CERTIFICATE OF CORRECTION

PATENT NO. : 5,485,187

DATED : January 16, 1996

INVENTOR : YOSHITAKA OKAMURA ET AL.

It is certified that errors appears in the above-identified patent and that said Letters Patent is hereby corrected as shown below:

ON TITLE PAGE , line 9,

In [57] ABSTRACT: "compriss" should read --comprises--.

COLUMN 1

Line 28, "cap" should read --a cap--.

COLUMN 4

Line 63, "hi" should read --$h_1$--.

COLUMN 5

Line 1, "hi" should read --$h_1$--.
Line 13, "13" should read --3--.

UNITED STATES PATENT AND TRADEMARK OFFICE

CERTIFICATE OF CORRECTION

PATENT NO. : 5,485,187

DATED : January 16, 1996

INVENTOR : YOSHITAKA OKAMURA ET AL.

It is certified that errors appears in the above-identified patent and that said Letters Patent is hereby corrected as shown below:

COLUMN 7

Line 38, "ink.-jet" should read --ink-jet--.

COLUMN 8

Line 36, "enable" should read --enables--.
Line 46, "for." should read --for--.

COLUMN 9

Line 59, "preheating" should read --pre-heating--.

COLUMN 11

Line 13, "tank" should read --ink tank--.
Line 50, "in" should read --ink--.

UNITED STATES PATENT AND TRADEMARK OFFICE

CERTIFICATE OF CORRECTION

PATENT NO. : 5,485,187

DATED : January 16, 1996

INVENTOR : YOSHITAKA OKAMURA ET AL.

It is certified that errors appears in the above-identified patent and that said Letters Patent is hereby corrected as shown below:

COLUMN 12

Line 3, "said ink" should read --said large ink--.

Signed and Sealed this

Sixth Day of August, 1996

*Attest:*

*Attesting Officer*

BRUCE LEHMAN

*Commissioner of Patents and Trademarks*